United States Patent [19]

Bödewein

[11] Patent Number: 4,704,930

[45] Date of Patent: Nov. 10, 1987

[54] METHOD AND APPARATUS FOR REMOVING EDGE STRIPS FROM MATERIAL WEBS OF PAPER, CARDBOARD OR THE LIKE

[75] Inventor: Jakob Bödewein, Monchen-Gladbach, Fed. Rep. of Germany

[73] Assignee: Jagenberg AG, Dusseldorf, Fed. Rep. of Germany

[21] Appl. No.: 919,629

[22] Filed: Oct. 15, 1986

Related U.S. Application Data

[63] Continuation of Ser. No. 729,383, May 1, 1985, abandoned.

[30] Foreign Application Priority Data

May 3, 1984 [DE] Fed. Rep. of Germany ..... 3416341

[51] Int. Cl.[4] ..... B26D 1/143; B26D 1/24

[52] U.S. Cl. ..... 83/24; 83/100; 83/102; 83/425.4; 83/498; 83/500

[58] Field of Search ..... 83/23, 24, 27, 100, 83/98, 99, 102, 105, 289, 300, 407, 425, 425.4, 500–503, 479, 498; 493/82, 342, 373

[56] References Cited

U.S. PATENT DOCUMENTS

| | | | |
|---|---|---|---|
| 2,160,999 | 6/1939 | Yoder | 83/105 |
| 3,272,651 | 9/1966 | Quirk | 83/100 X |
| 3,465,625 | 9/1969 | Daly | 83/100 |
| 3,831,929 | 8/1974 | Hellmer | 83/479 X |
| 3,916,743 | 11/1975 | Naudascher et al. | 83/86 |
| 4,041,819 | 8/1977 | Chu | 83/302 |
| 4,201,256 | 5/1980 | Truhan | 83/100 X |
| 4,242,934 | 1/1981 | Coburn | 83/100 |
| 4,300,421 | 11/1981 | Yano | 83/100 X |
| 4,367,665 | 1/1983 | Terpstra | 83/100 |
| 4,410,315 | 10/1983 | Frye | 83/98 X |
| 4,484,500 | 11/1984 | Reba et al. | 83/407 X |
| 4,501,177 | 2/1985 | Logan et al. | 83/105 X |

FOREIGN PATENT DOCUMENTS 2347889 4/1975 Fed. Rep. of Germany .

*Primary Examiner*—Frank T. Yost

*Attorney, Agent, or Firm*—Sprung Horn Kramer & Woods

[57] ABSTRACT

In a double longitudinal cutter, a suction device (18) is provided for removing edge strips produced at the time of longitudinal cutting, which is located in the region of the double longitudinal cutter arranged between an upper web and a lower web and is provided with bent suction nozzles (19,20,21,22,23,24) by which the edge strips can be removed by suction after being guided over the lower cutter of the pairs of circular cutters provided for longitudinal cutting. The suction above the lower cutters (11,12) allows a removal of the edge strips in the narrowest space, while maintaining satisfactory quality of the longitudinal cut.

12 Claims, 4 Drawing Figures

Figure 1:
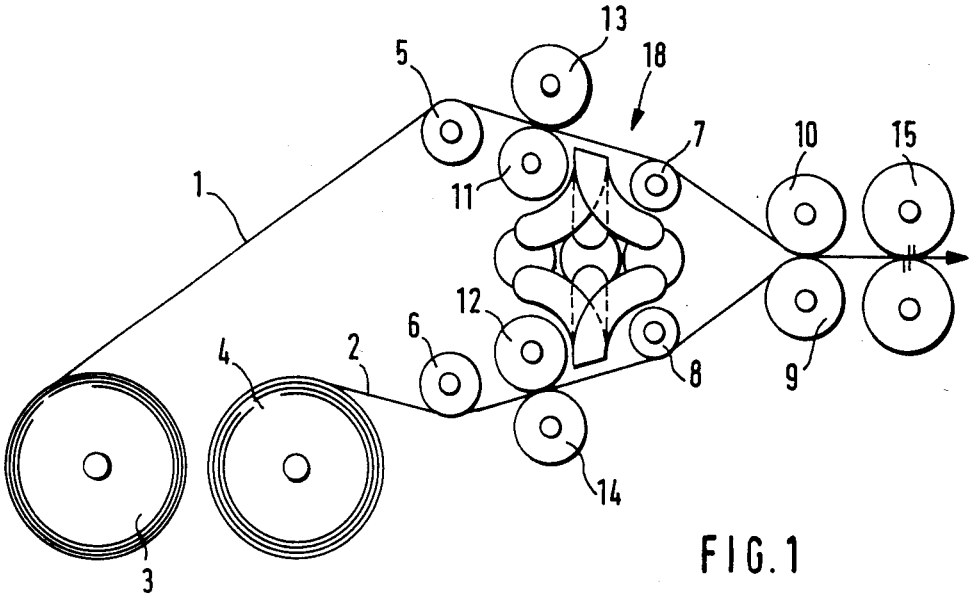

METHOD AND APPARATUS FOR REMOVING EDGE STRIPS FROM MATERIAL WEBS OF PAPER, CARDBOARD OR THE LIKE

This application is a continuation of application Ser. No. 729,383, filed May 1, 1985, now abandoned.

The invention relates to a method for removing edge strips from material webs of paper, cardboerd or the like, which are divided into two webs lying at a distance apart and are each cut longitudinally by at least one pair of circular cutters consisting of upper cutter and lower cutter.

A method of this type for removing the edge strips of material webs having one or more layers is known from German Offenlegungsschrift No. 23 47 889. In this way, comparatively wide material webs can be divided into several narrow webs. In double longitudinal cutting machines of this type, it is known from practice to remove the edge strips produced at the time of longitudinal cutting of the material webs by way of a removal device in the form of a suction device. For this purpose suction nozzles are provided above and below the respective web, by means of which the edge strips produced can be removed by suction after being guided over the upper cutter of the respective pair of circular cutters. The suction nozzles are readjusted by hand according to the adjustable positions of the pairs of circular cutters acting as edge cutters. Particularly the super structures for the suction of the edge strips above the machine and the necessary lateral joint guidance of the upper and lower suction means are quite expensive, require a lot of space and also considerably limit the accessibility to the longitudinal cutting machine. However, it is to be seen as the most essential drawback of the known arrangement that due to the guidance and removal of the edge strip by suction respectively over the upper cutter of the pair of circular cutters, the quality of the longitudinal cut is necessarily impaired.

The object of the invention is to provide a method and apparatus for removing edge strips from material webs of paper, cardboard or the like in double longitudinal cutting machines, in order to ensure rapid and trouble-free removal of the edge strip whilst maintaining a good quality of cut in the narrowest space.

This object is achieved according to the invention due to the fact that the edge strips are guided inwards over the lower cutters and removed. With the means according to the invention it is first of all ensured that the same satisfactory quality of cut is achieved, as is known in single longitudinal cutting machines and in which case the use of each pair of cutters as edge cutters is possible at the same time. Furthermore, the space above and below the webs is easily accessible, since the removal of the edge strip takes place between the two webs.

For the purpose of adaptation to material webs of different width, the pairs of circular cutters and the edge strip removal means can be adjusted jointly.

Also belonging to the invention is an apparatus suitable for carrying out the method, which is characterised by the fact that a removal device for the edge strips produced is provided, the said device being located between the material webs cut by the longitudinal cutters. The particular problem consists of having to locate this removal device in the narrowest space, namely in the space remaining between the material webs. This problem is particularly difficult due to the fact that the distance between a preliminary drawing part of a transverse cutter generally following a longitudinal cutter must be kept invariably short, so as not to alter the running behavior of the longitudinally cut material webs. Otherwise this leads to the formation of creases or to sagging of the material webs and thus to wandering of the material webs finally guided together again in the preliminary drawing part. Moreover, the looping angle of the material webs around guide rollers serving for their guidance must be kept small, in order that no renewed bending occurs in a material web which had previously been flat.

In spite of these particular difficulties, a fully functional removal device for the edge strips produced has been provided in the narrowest space.

This is achieved in a further embodiment of the invention due to the fact that the removal device appropriately constructed as a suction device comprises at least one pair of suction nozzles reaching into the region of the lower cutters of the pairs of circular cutters, on each side of the double longitudinal cutter.

In a specific embodiment of the invention, it is provided that the suction nozzle or nozzles arranged in pairs are arranged in a Y-shape with respect to each other and each pass into common guide members, which are connected to connecting members.

All the other features described contributed ingeniously to locating the removal device in a skilled manner in the comparatively restricted space between the material webs, without having to vary the distance between the pairs of circular cutters and the preliminary drawing part of a subsequent transverse cutter. In this case, primarily it is essential that the suction nozzles and the guide members are curved and have the minimum radii of curvature and cross sections necessary for trouble free removal of the edge strips.

For a compact installation of the parts of the suction device, it is also a contribution if several guide members are arranged to lie one behind the other, seen in the direction of travel of the web and are guided substantially parallel to each other if necessary with the interposition of extension members, and in which case the suction nozzles lying farthest out in the double longitudinal cutter are bent substantially in one plane towards the lower cutters and the other suction nozzles located on both sides of this plane are bent by way of addition towards the first plane.

Finally, it is also of great significance for the invention that the suction nozzles and possibly the extension members and the guide members are constructed to be adjustable together with adjusting carriages for the pairs of circular cutters, i.e. the carriage and suction pipe of the suction device form a mechanical unit. This is an advantage since in double longitudinal cutting machines, in practice the cutter units are pre-selected and adjusted in a completely motorized manner by means of a programmed control arrangement.

A preferred embodiment of the invention is illustrated in the drawings and described in detail hereafter.

Figure 2:
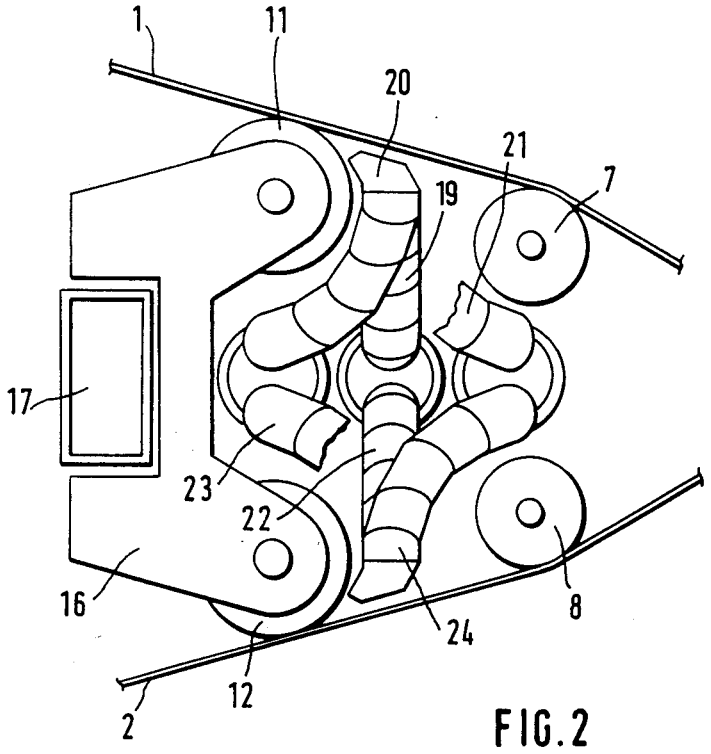
Figure 3:
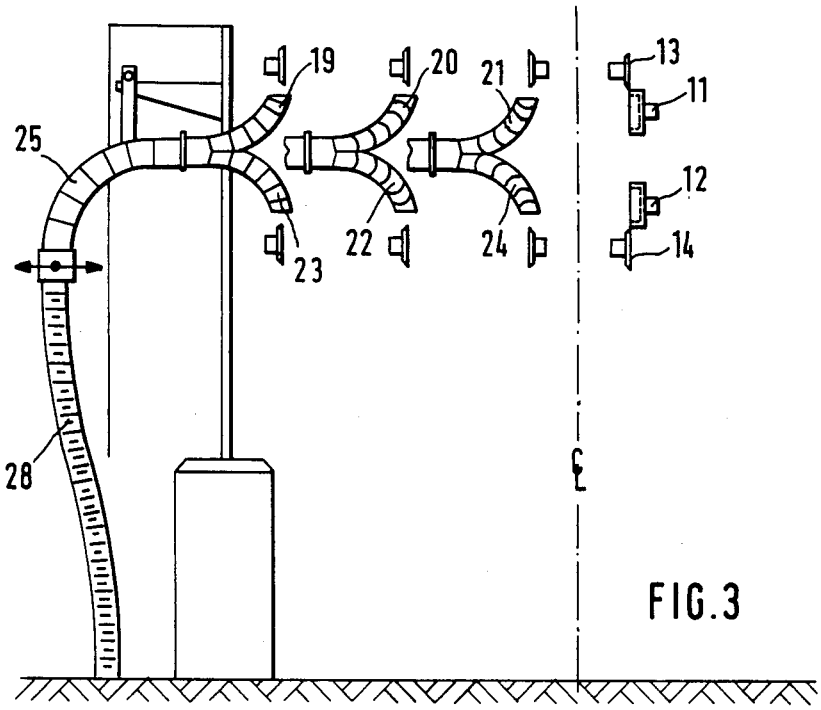
Figure 4:
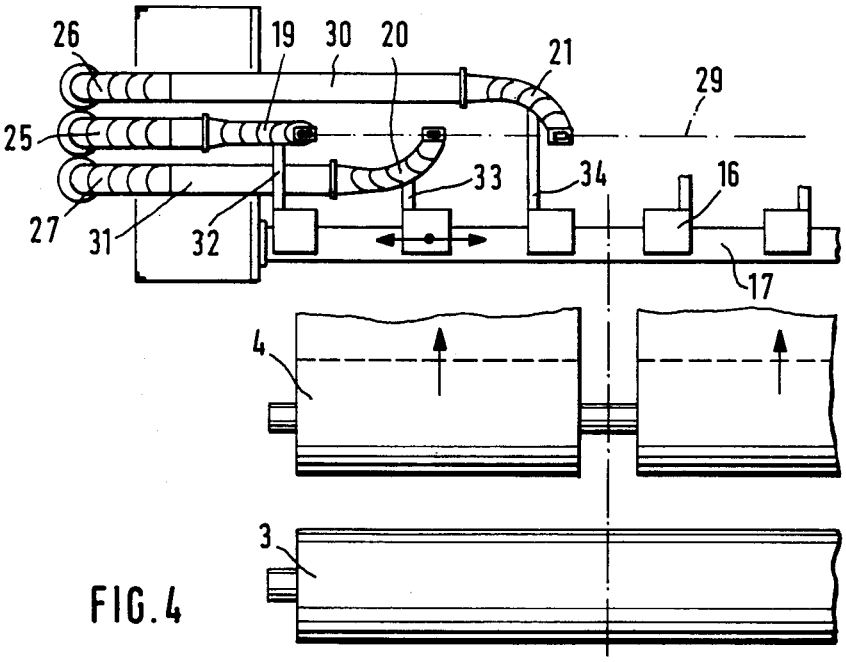

FIG. 1 is a diagrammatic side view of a double longitudinal cutting machine, FIG. 2 is an enlarged cutaway portion of the side view illustrated in FIG. 1, FIG. 3 is a diagrammatic front view of part of the double longitudinal cutting machine and FIG. 4 is a diagrammatic plan view of the longitudinal cutting machine.

As can be seen from FIGS. 1 and 3, material webs 1, 2 of paper, cardboard or the like are guided from a braked roll 3 which is the width of the machine or however, narrower rolls 4 arranged in pairs over guide rollers 5,6,7 and 8. Located behind the guide rollers 7 and 8 is a lower roller 9 and an upper roller 10 of a preliminary drawing part, by which the material webs 1 and 2 are drawn into a transverse cutting station 15. During this preliminary drawing movement, the material webs 1 and 2 are cut in the longitudinal direction by longitudinal cutting devices. The longitudinal cutting devices consist respectively of a pot cutter 11, 12 and an point cutter 13, 14. The pot cutter 11 and the point cutter 13 as well as the pot cutter 12 and the point cutter 14 thus respectively form a pair of circular cutters. It will be understood that several pairs of circular cutters can be located at a distance apart one behind the other distributed transversely over the width of the material webs. In the present case one proceeds on the assumption that six pairs of circular cutters are provided for each half of the machine and in particular three point pairs of circular cutters and three pot pairs of circular cutters for the material web 1 respectively material web 2.

In order to be able to provide an adaptation to material webs 1, 2 of different widths, the pairs of circular cutters can be shifted at right angles to the material webs 1 and 2. For this purpose, the pot cutters 11, 12 are respectively seated on a carriage 16, which is in turn mounted to move on a cross bar 17 which is as wide as the machine.

In a manner to be described hereafter, each pair of circular cutters can be used as edge cutters, so that edge strips are produced. These edge strips must be removed in a suitable manner, i.e. so that the quality of the longitudinal cut is not impaired. For this purpose the edge strips are guided inwards respectively over the pot cutters 11, 12 and removed. Serving for the removal is a suction device 18, which is located between the material webs 1 and 2 and behind the pairs of circular cutters. The suction device 18 comprises a suction nozzle 19,20,21,22,23 and 24 associated with each pair of circular cutters and leading to the pot cutter 11, 12. As can be seen from FIG. 3, the suction nozzles 19, 20,21,22,23 and 24 are arranged in pairs in the form of a fork or in a Y-shape with respect to each other and are bent and pass respectively into a bent guide member 25, 26 and 27. The guide member 25,26, 27 are each connected to a connecting member 28 constructed to be elastically yielding, whereof FIG. 3 shows solely the connecting member illustrated with the guide member 25.

From FIG. 4 it can be seen that the guide member 25 is bent in a common plane 29 with the suction nozzle 19 and the suction nozzle 23 (FIG. 3). The radii of curvature and the cross sections of the guide members 25,26,27 and of the suction nozzles 19, 20,21,22,23,24 are chosen so that trouble-free removal of the edge strip is possible. With radii which are too small, backing-up of the edge strip occurs, which prevents rapid and satisfactory removal. In contrast to the guide member 25 and suction nozzles 19, 23, which are connected directly to each other, in the case of the other guide members 26, 27 and the suction nozzles 20,22 respectively 21,24, extension members 30,31 are interposed, in order that the said suction nozzles can be located further inwards with respect to the machine and in particular in the region of the pairs of circular cutters provided therein. In order to be able to adapt the pairs of circular cutters and the suction nozzles of the suction device 18 to different widths of material web, an adjusting device is provided, to which the previously described cross bar 17 and carriages 16 belong. The respective carriages 16 are fixed by way of clamps 32,33,34, to the suction nozzles 19,23 respectively 20,22 respectively 21,24 so that the pairs of circular cutters and the suction nozzles can be adjusted together as one unit. The elastically yielding connecting member 28 belonging to each suction member, which lies outside the machine frame, equalizes the necessary axial displacement travel. The suction operating for the respective edge cutter can be preselected and then started or stopped by way of control slides on the pipes guided together outside the machine.

It will be understood that the specification and examples are illustrative but not limitative of the present invention and that other embodiments within the spirit and scope of the invention will suggest themselves to those skilled in the art.

I claim:

1. A method of removing edge strip from webs of paper, cardboard, or the like, comprising providing two webs, passing the webs onto first guide rollers to space the two webs apart with one web over the other, passing the webs through second guide rollers downstream of the first guide rollers to dispose the webs in a superposed relationship, and between the first and second guide rollers, cutting each web along at least one edge longitudinally by pairs of circular cutters each pair including a point cutter and a pot cutter to form edge strips, guiding the cut edge strips from outer edges inwardly over the pot cutter and removing the edge strips with removing means associated with each cutter.

2. The method according to claim 1, further comprising adjusting each of the circular cutters and its associated edge strip removing means for adapting to material webs of different width.

3. In an apparatus for removing edge strips from spaced superposed webs, comprising longitudinal cutters with at least one pair of circular cutters including a point cutter and pot cutter, the improvement which comprises a removal device for the edge strip produced located between the spaced superposed webs cut by the longitudinal cutters.

4. An apparatus according to claim 3, wherein the removal device is a suction device.

5. An apparatus according to claim 4, wherein each circular cutter comprises a double longitudinal cutter having two sides, and the suction device comprises at least one pair of suction nozzles reaching into the region of the pot cutter of each pair of circular cutters.

6. An apparatus according to claim 5, wherein the at least one pair of suction nozzles are arranged in a Y-shaped or fork shape with respect to each other and each pass into common guide mmebers which are connected to connecting members.

7. An apparatus according to claim 6, wherein the suction nozzles and the guide members are bent and their minimum radii of curvature and cross section are correlated for trouble-free removal of the edge strips.

8. An apparatus according to claim 6, wherein said seen in the direction of travel of the webs several guide members lie one behind the other and are guided substantially parallel to each other.

9. An apparatus according to claim 6, including means for displacing, transversely to the direction of travel of the webs, the suction nozzles, the guide members and the pairs of circular cutters.

10. An apparatus according to claim 9, wherein the displacing means includes a carriage carrying the suction nozzles and pairs of circular cutters so they are displaced together as a unit.

11. An apparatus according to claim 6, wherein the connecting members are constructed to be elastically yielding.

12. An apparatus according to claim 5, wherein the suction nozzles lying farthest outwardly relative to the web edges in the double longitudinal cutter are bent towards the lower cutters substantially in a given plane, and the other suction nozzles located on both sides of the given plane are bent towards the given plane.

* * * * *

UNITED STATES PATENT AND TRADEMARK OFFICE

CERTIFICATE OF CORRECTION

PATENT NO. : 4,704,930

DATED : Nov. 10, 1987

INVENTOR(S) : Bödewein

It is certified that error appears in the above-identified patent and that said Letters Patent is hereby corrected as shown below:

| | |
|---|---|
| Col. 4, line 41 | Insert --two spaced-- after "comprising" |
| Col. 4, line 57 | Correct spelling of --members-- |
| Col. 4, line 63 | Delete "said" and insert --as-- |

Signed and Sealed this

Twenty-fourth Day of May, 1988

*Attest:*

DONALD J. QUIGG

*Attesting Officer*

*Commissioner of Patents and Trademarks*